United States Patent [19]

Falbel

[11] 4,365,149

[45] Dec. 21, 1982

[54] MORTAR FIRE CONTROL SYSTEM

[75] Inventor: Gerald Falbel, Stamford, Conn.

[73] Assignee: The United States of America as represented by the Secretary of the Army, Washington, D.C.

[21] Appl. No.: 174,093

[22] Filed: Jul. 31, 1980

[51] Int. Cl.[3] ..... G06F 15/58; F41G 1/34; F41G 3/00

[52] U.S. Cl. ..... 235/404; 89/41 E; 89/41 L; 356/152; 364/423

[58] Field of Search ..... 364/423; 235/404; 89/41 E, 41 L; 356/141, 152

[56] References Cited

U.S. PATENT DOCUMENTS 4,026,190 5/1977 Blair ..... 89/41 L X
4,126,394 11/1978 Ulrich ..... 356/152
4,277,169 7/1981 Krieg ..... 356/152

*Primary Examiner*—Felix D. Gruber

*Attorney, Agent, or Firm*—Nathan Edelberg; Robert P. Gibson; Max Yarmovsky

[57] ABSTRACT

A mortar fire control system for indicating azimuth, elevation and cant angular orientations of a mortar barrel. The system comprises a 3-axis optical head mounted adjacent the mortar barrel which emits light pulses in two predetermined directions, 90° apart, towards aiming stakes. Two aiming stakes located at approximately 50 meters and 100 meters from the mortar are aligned along one of the predetermined directions while a third aiming stake is situated 90° away from the first two aiming stakes and at a distance of approximately 50 meters from the mortar. Each of the aiming stakes is provided with an optical transponder for receiving the light pulses emitted from the optical head and for retransmitting a light pulse to said optical head. The light pulses received by the optical head are converted into digital information representative of the azimuth, elevation and cant angular orientations of the mortar barrel relative to predetermined initial values of each of these three parameters.

11 Claims, 17 Drawing Figures

MORTAR FIRE CONTROL SYSTEM

GOVERNMENTAL INTEREST

The invention described herein was made in the course of a contract with the Government and may be manufactured, used and licensed by or for the Government for governmental purposes without the payment to us of any royalty thereon.

BACKGROUND OF THE INVENTION

1. Field of the Invention

The invention relates generally to fire control systems for controlling and aiming weapons. More particularly, the invention relates to fire control systems for controlling and aiming mortars.

2. Description of the Prior Art

Prior art mortar fire control systems are generally manual operator-controlled systems usually consisting of a simple telescopic sight mounted adjacent a mortar barrel and utilized in conjunction with two (sometimes one) aiming stakes set at approximately 50 meters and 100 meters from the telescopic sight and at a certain predetermined angle from the forward direction of the mortar. Elevation and azimuth angular orientations of the mortar barrel relative to the aiming stakes are determined by observation of elevation and azimuth angular scales which show the respective elevation and azimuth positions of the telescopic sight relative to some predetermined orientation.

In certain prior art applications the aiming stakes are equipped with light reflectors for reflecting a continuous light beam from the telescopic sight. Generally these auxiliary light reflectors are utilized at night and differentiate the aiming stakes by, for example, reflecting red light from the first aiming stake and reflecting green light from the second or far aiming stake.

The prior art procedure for controlling the fire of a mortar is based essentially upon the use of the aforementioned aiming stakes. The gunner, or person operating the mortar, is generally able to aim the mortar at any target by varying the azimuth and elevation orientations of the mortar barrel relative to predetermined referenced azimuth and elevation angles established by the position of the aiming stakes relative to the mortar.

The prior art aiming procedure is generally as follows:

Once the mortar is placed in a desired location and leveled, two aiming stakes are placed on a straight line running from the mortar position in a convenient direction. These aiming stakes are usually placed at approximately 50 meters and 100 meters respectively. In any event, the far aiming stakes should be approximately twice as far from the mortar as the near aiming stake.

After the mortar and the aiming stakes are placed, it is necessary to "refer" the telescopic sight. This is generally done by aligning the sight with the two aiming stakes without disturbing the lay of the mortar. A procedure for referring the sight may differ slightly depending upon the particular mortar telescopic sight which is used although, in general, the concept of referring the sight to establish a reference line for aiming the mortar is almost always followed. However, the initial angular orientation on the telescopic sight may vary depending upon the type of sight used. The line of sight of the sight unit is generally aligned with the straight line formed by the aiming stakes which are generally not placed directly in front of the mortar since the line of sight to the stakes will be blocked by the barrel when the sight is turned to the right a predetermined amount (approximately 1,300 mils since the sight is generally mounted on the left side of the barrel). To reduce this limitation the aiming stakes are normally placed to the left front of the mortar.

Once the mortar sight is "referred" the mortar barrel position (angular and elevational) may be altered within a predetermined range in order to aim the mortar at targets relative to the reference angular and elevation orientations. Aiming outside this predetermined range requires re-setting the aiming stakes and repeating the "referring" of the telescopic sight.

Prior art mortar fire control systems are two dimensional systems which are not capable of 3-axis control of mortar fire since the telescopic sight used in conjunction with prior art mortars consists of a single axis telescope having a reticle using vertical and horizontal cross-hairs only. Thus, prior art mortar fire control systems are subject to a certain amount of aiming error because they are unable to sense the third dimension or cant angular orientation of the mortar barrel relative to a predetermined reference.

Moreover, prior art mortar fire control systems require the gunner to observe considerable care in setting up and aligning the aiming stakes through the telescopic sight. This necessarily delays the availability of the mortar for firing and prevents the gunner from rapidly changing or correcting the aiming reference line of the mortar in order to hit a target.

Accordingly, there exists a need for a mortar fire control system capable of efficiently and rapidly indicating the azimuth, elevation and cant angular orientations of a mortar barrel relative to predetermined reference values of these parameters.

SUMMARY

This invention discloses a mortar fire control system for efficiently and rapidly indicating azimuth, elevation and cant angular orientations of a mortar barrel. The invention comprises a 3-axis optical head for being mounted adjacent a mortar barrel and for emitting and receiving light pulses in a predetermined sequence. The system also includes optical transponders situated on each of three aiming stakes for operation in conjunction with the aforementioned optical head. Two aiming stakes are aligned in a predetermined direction relative to the mortar barrel and spaced at approximately 50 and 100 meters therefrom for providing the azimuth and elevation reference information of the mortar fire control system embodiment of the invention. A third aiming stake is displaced 90° from the other two aiming stakes and is situated at approximately 50 meters from the mortar and provides the cant angular information for the mortar fire control system. Upon the firing of an initial light pulse from the optical head towards the first two azimuth and elevation aiming stakes, the near aiming stake retransmits, after 1 millisecond, a first light pulse back to the optical head while the far aiming stake retransmits, after 2 milliseconds, a second light pulse back to the optical head. Two milliseconds after the initial light pulse was transmitted, the optical head transmits secondary light pulse toward aiming stake number 3 which, after a 1 millisecond delay, retransmits a third light pulse back to the optical head. The light pulses transmitted from the three optical transponders arrive at the optical head at three discrete times and are converted via digital gray-coded mask to a binary number representative of the azimuth, elevation and cant angular orientations of the mortar barrel relative to a predetermined reference.

DETAILED DESCRIPTION OF THE PREFERRED EMBODIMENT

Figure 1:
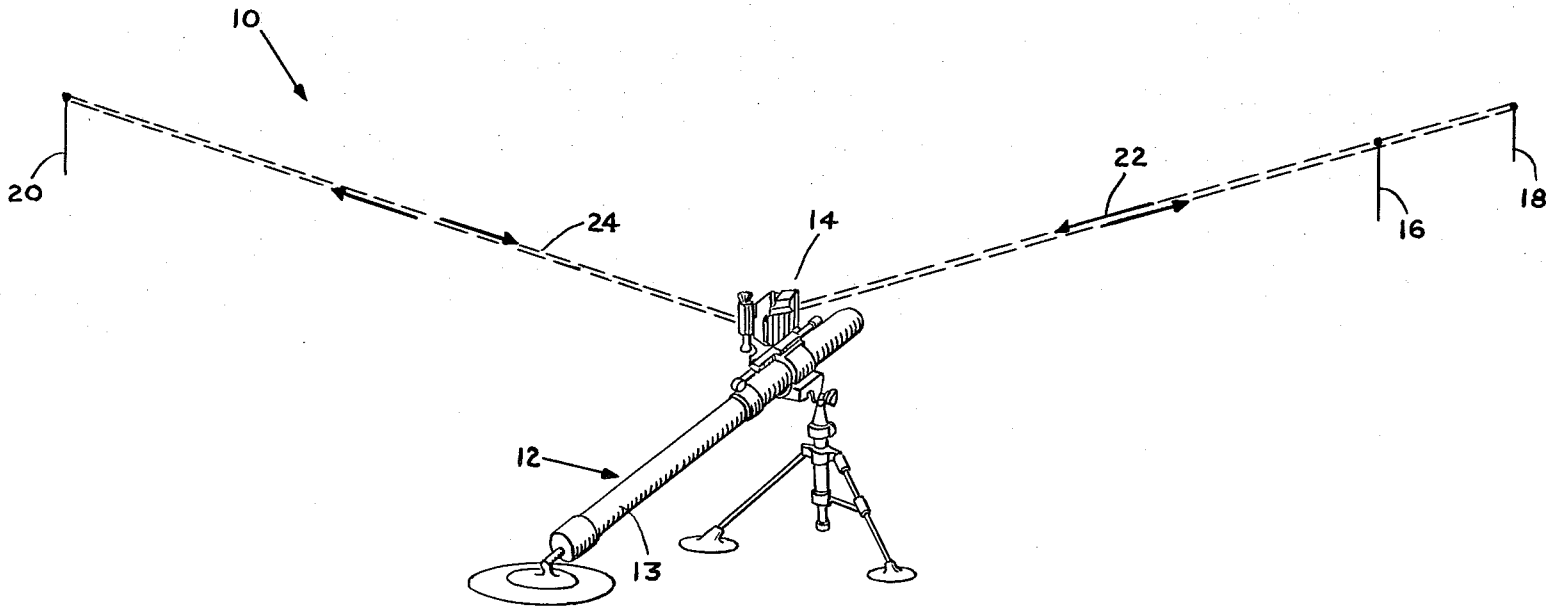
FIG. 1 is a perspective view of the mortar fire control system of the invention mounted adjacent a mortar and showing relative placement of the mortar and the aiming stakes.

Referring now to FIG. 1 there is shown a diagrammatic representation of the mortar fire control system 10 of the present invention in conjunction with a mortar 12 having mortar barrel 13. The system 10 comprises an optical head 14 and aiming stakes 16, 18 and 20.

Aiming stakes 16 and 18 are aligned along line 22 and, in the preferred embodiment, are situated 50 meters and 100 meters respectively from optical head 14. While the absolute distance of the aiming stakes from optical head 14 need not necessarily be 50 meters and 100 meters respectively, aiming stake 18 should be approximately twice as far from optical head 14 as aiming stake 16. Aiming stake 20 is, in the preferred embodiment, situated approximately 50 meters from optical head 14 and along line 24, line 22 and line 24 being displaced by approximately 90°. Those skilled in the art will understand that line 22 should not be aligned with the mortar barrel but, if optical head 14 is mounted on the left of the mortar barrel then line 22 should be displaced a predetermined angular amount to the left of the line (not shown) aligned with mortar barrel 13. This arrangement of line 22 is similar to the setting of aimimg stakes used in the prior art.

Figure 2:
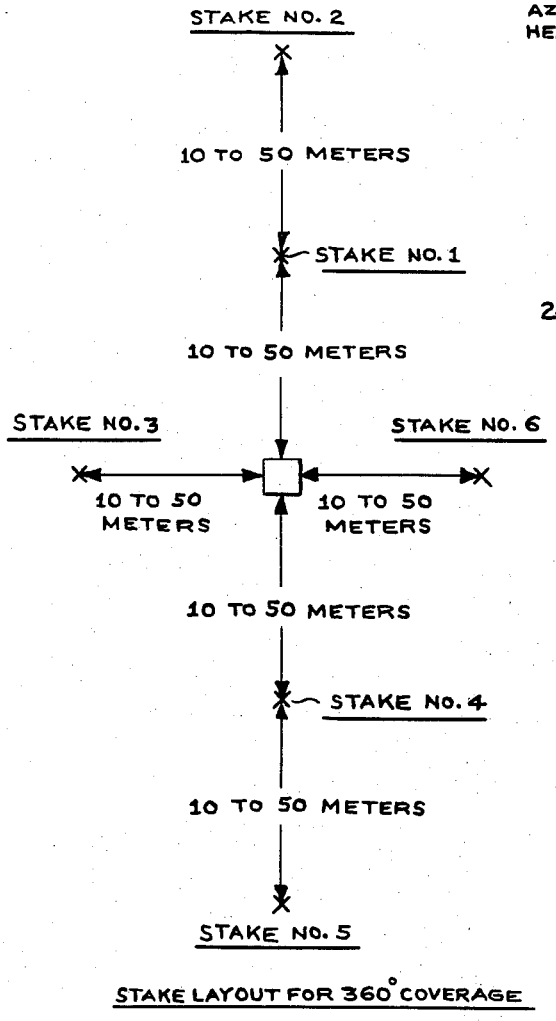
FIG. 2 is a schematic representation of the relative placement of the mortar and aiming stakes required for 360° coverage.

While aiming stakes 16, 18 and 20 shown in FIG. 1 enable the accurate firing and aiming of mortar 12 within a certain sector, if a 360° coverage of the mortar is desired, 6 aiming stakes should be used and arranged as shown in FIG. 2.

Figure 3:
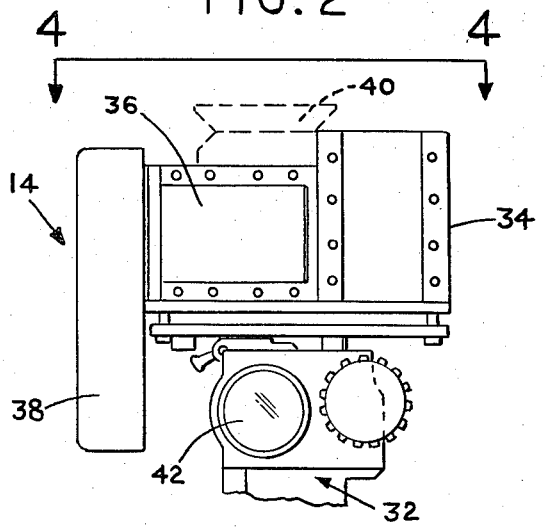
FIG. 3 is a schematic representation of a front-view of the optical head mounted adjacent the standard telescope of a mortar.

Referring now to FIG. 3, there is shown a front-view of an optical head 14 mounted on a standard prior art telescopic mount 32 of mortar 12 (not shown). Optical head 14 includes an azimuth optical head portion 34, an elevation/cant optical head portion 36 and an electronics package 38. Telescope 40 which is normally mounted to telescopic mount 32 and which is normally used with mortar 12 in prior art fire control systems is bore-sighted with azimuth optical head 34 and is shown in FIG. 3 to facilitate an understanding of the orientation of optical head 14 relative to the mortar and telescope. It will be understood by those skilled in the art that telescope 40 is a right-angle type of telescope enabling the operator or gunner to look through lens 42 of telescope 40 while looking down in direction 44 into telescope 40. The telescope may be used in initial alignment of the optical head 14 and aiming stakes 16 and 18. However, as will be seen below, one advantage of this invention over the prior art is that the alignment of the telescope with the aiming stakes is quicker and easier since it need not be as accurate as in prior art systems since the optical head 14 automatically takes into account any errors in initial alignment. Indeed, those skilled in the art will understand from the following disclosure that only the near aiming stake 16 need be aligned with telescope 40 since the system 10 will automatically determine the initial and subsequent positions of the aiming stakes relative to mortar 12.

Figure 4:
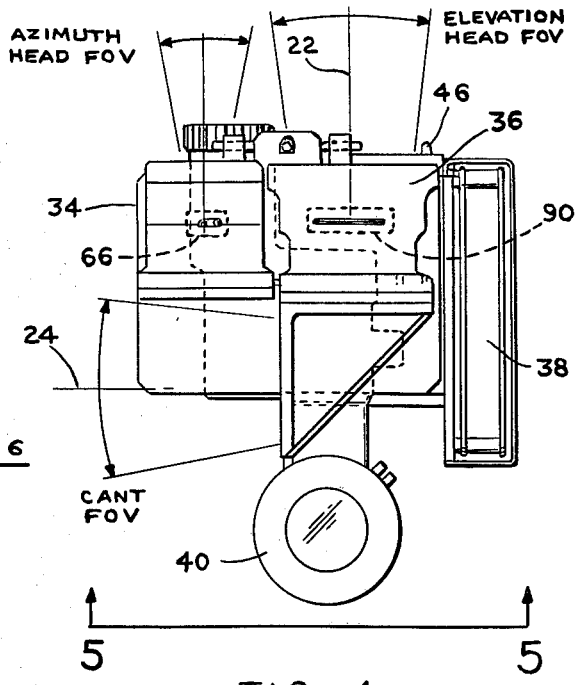
FIG. 4 is a plan-view of the optical head taken along the line 4—4 of FIG. 3.

FIG. 4 is a plan-view of optical head 30 taken along line 4–4 of FIG. 3 and more clearly shows the outline and relative arrangement of azimuth head 34, elevation head 36, electronics package 38 and telescope 40. FIG. 4 also shows the position of light emitting diode 46 which faces toward aiming stakes 16 and 18 parallel with line 22 and which serves in the preferred embodiment as a light source emitting an initial light pulse which, as will be described below, is received and retransmitted by optical transponder on aiming stakes 16 and 18.

Figure 5:
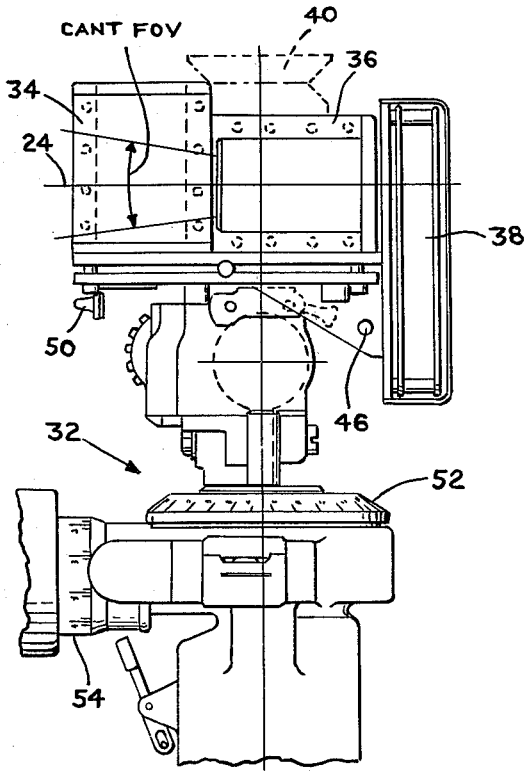
FIG. 5 is a rear elevational view of the optical head of FIG. 4 taken along the line 5—5.

FIG. 5 is a rear elevational view of optical head 14 taken along the line 5—5 of FIG. 4. The full outline of telescope 40 is not included in FIG. 5 in order to more clearly show the arrangement of parts. It is noted that light emitting diode 50 is shown facing toward aiming stake 20 parallel with line 24. Azimuth scale 52 and elevation scale 54 which are standard parts of telescopic mount 32 are also shown to clarify the relationship of the various components to each other.

Figure 6:
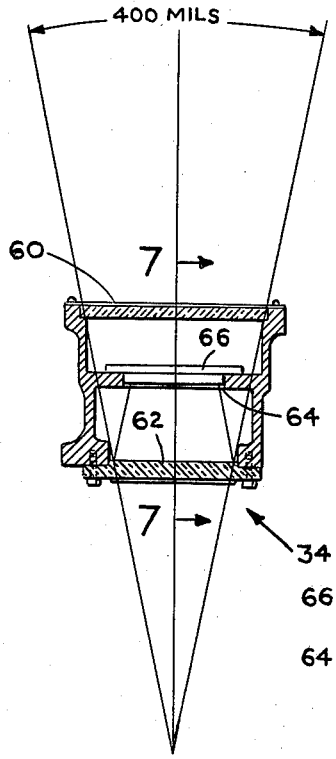
FIG. 6 is a side cross-sectional view of the azimuth optical head.
Figure 7:
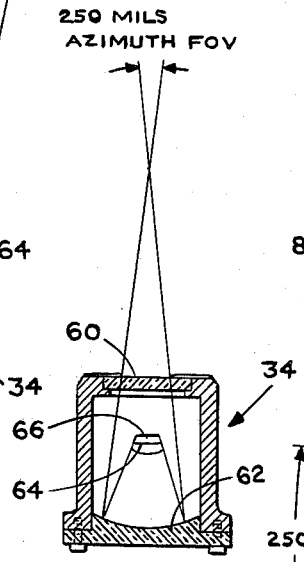
FIG. 7 is a top cross-sectional view of the azimuth optical head taken along the line 7—7 of FIG. 6.

Referring now to FIGS. 6 and 7 there is shown a side cross-sectional view and top cross-sectional view respectively of azimuth optical head 34 including a face plate 60, a cylindrical mirror 62, a field flattener 64 and a silicon detector array 66. Face plate 60 is optimally selected to be transparent to that frequency of light which is selected for use with the system. Such selectivity enhances the operation of the system by preventing the azimuth optical head 34 from detecting frequencies other than those reflected from aiming stakes. In the preferred embodiment, azimuth optical head 34 is selected to have an azimuthal range or field of view of ±125 mils. The elevational field of view of the azimuth optical head 34, while not necessarily significant since it does not effect azimuthal resolution, is in the preferred embodiment selected to be approximately 400 mils in order to assure reception of azimuthal light pulses over a reasonably broad elevation range.

Figure 8:
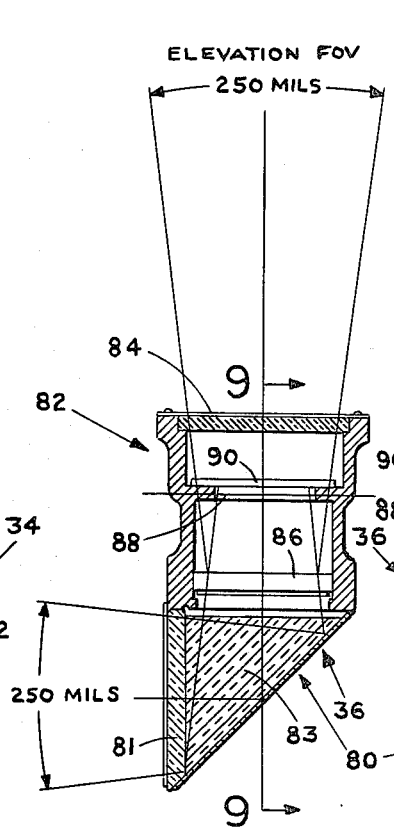
FIG. 8 is a top cross-sectional view of the elevation/-cant optical head.
Figure 9:
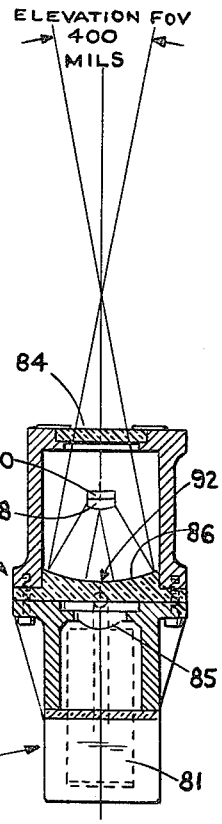
FIG. 9 is a side cross-sectional view of the elevation/-cant optical head taken along line 9—9 of FIG. 8.

Referring now to FIGS. 8 and 9, there is shown a top cross-sectional view and a side cross-sectional view respectively of elevation/cant optical head 36 which consists of a cant portion 80 and an elevation portion 82.

Elevation portion 82 consists of a face plate 84, a special cylindrical mirror 86, a field flattener 88 and a silicon detector array 90.

The cant portion 80 of elevation optical head 36 consists of a base plate 81, a 45°×45°×90° prism 83 and a cylindrical lens system 85.

Cant portion 80 and elevation portion 82 of the elevation optical head 36 utilize the same silicon detector array 90 by virtue of the special construction of cylindrical mirror 86. Cylindrical mirror 86 is reflective along its entire surface except for a small transparent zone 92 centrally located and aligned along its surface. It is through this transparent zone 92 that cylindrical lens system 85 focuses light received through cant portion 80 and prism 83 onto silicon detector array 90.

While detector array 90 has superimposed upon it light information signals reflected from the reflective portion of cylindrical mirror 86 as well as light information signals transmitted through transparent zone 92, these two signals of light information are processed discretely, as will be seen below, so as not to cause interference therebetween.

In the preferred embodiment, the elevation portion 82 of elevation optical head 36 is selected to provide an elevation range or field of view of ±200 mils and the cant portion 80 of elevation/cant optical head 36 is selected to provide a cant field of view or range of ±125 mils. In a manner similar to that discussed above with respect to the azimuth optical head, the face plates 81 and 84 of the cant and elevation portions of the elevation/cant optical head 36 are selected to transmit a selected frequency of light to minimize background interference from sources other than aiming stakes.

Figure 10:
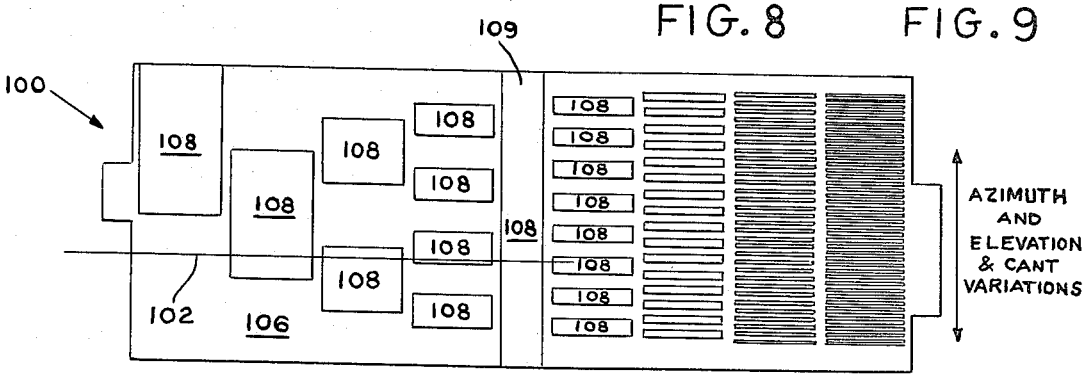
FIG. 10 is a schematic representation of the gray-coded field mask for covering the detector array.

It will be understood by those skilled in the art that a cylindrical lens or mirror system as utilized by the azimuth and elevation/cant optical heads will generally produce a line image at the focal point of the cylindrical system. FIG. 10, depicting a detector gray-coded field mask 100, clearly shows the schematic representation of the line image 102 produced by the aforementioned cylindrical mirror system. Field mask 100, which in the preferred embodiment has dimensions of approximately 1 inch by 0.4 inches, is constructed of photographic film having a thickness of approximately 0.005 inches and is designed to provide transparent areas of predetermined size and orientation against an opaque background 106. Background 106 could, for example, be a photographic film positive. The arrangement of transparent portions 108 on field mask 100 is provided as shown in FIG. 10 in order to divide field mask 100 into nine columns, each having a predetermined arrangement of clear and opaque portions and each extending across the width of mask 100.

Figure 11:
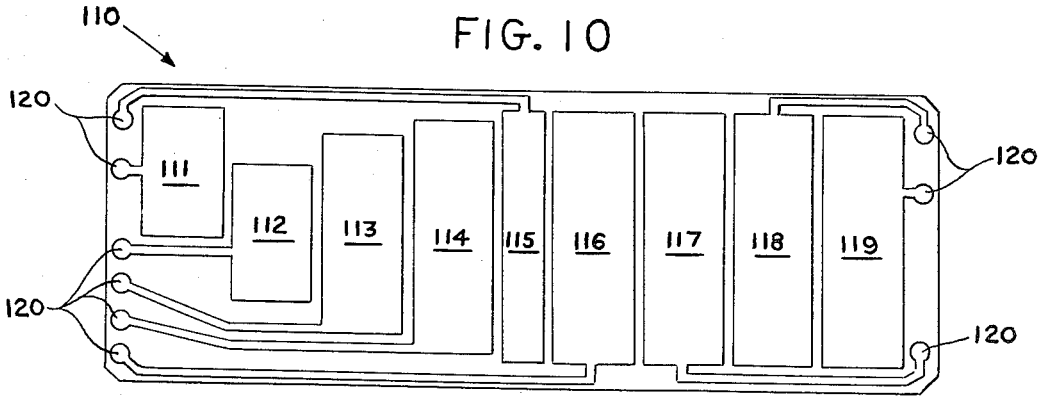
FIG. 11 is a schematic representation of the silicon detector array underlying the mask of FIG. 10.

In FIG. 11 there is shown a silicon detector array 110 for use in conjunction with field mask 100. It will be understood by those skilled in the art that when field mask 100 is placed over silicon detector array 110 only certain portions of the various detectors 111 to 119 will be "visible" through the mask. Detectors 111 through 119 are designed to produce an electronic signal at their respective terminal points 120 upon being irradiated with light of a predetermined frequency. The detector array 110 should be compatible with the frequency of light emitted by L.E.D.'s 46 and 50.

Returning now to FIG. 10, the position of line image 102 on field mask 100 will activate certain ones of detectors 111 to 119 in the silicon detector array 110 underlying field mask 100. Each of the detectors 111 to 119 are designed to produce a logical "1" whenever they are irradiated with light of a predetermined frequency and it necessarily follows that wherever line image 102 crosses a transparent portion 108 of field mask 100 then the corresponding detector underlying that particular transparent portion will generate a logical 1. In this manner, the various detectors 111 through 119 will generate a series of electronic signals according to whether or not they are irradiated with a portion of line image 102 and this series of "gray-coded" signals, after being processed in a manner well known to those skilled in the art may be presented in the form of a binary word. Thus, as line image 102 moves across the width of field mask 100 in response to varying angular orientations of aiming stakes relative to optical head 14 the binary word corresponding to the line image will necessarily change. As will be explained below in more detail, the various binary words obtained from various line images are in the preferred embodiment converted into azimuth, elevation and cant angular information.

Figure 12:
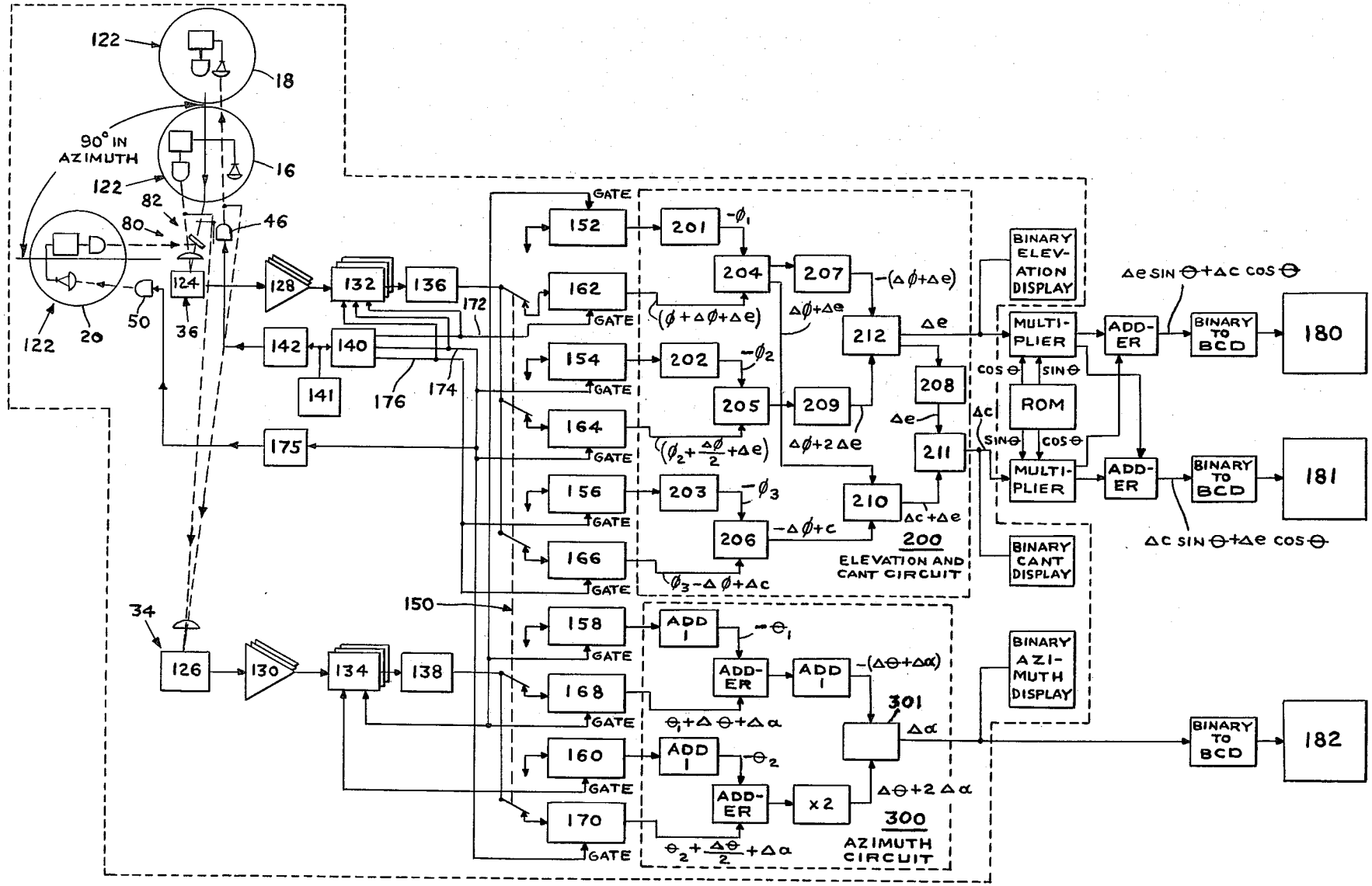
FIG. 12 is a schematic representation of the various components of the invention showing their relative relationships.

Referring now to FIG. 12 there is shown a schematic diagram of the various components of the mortar fire control system constructed in accordance with the principals of this invention.

Figure 13:
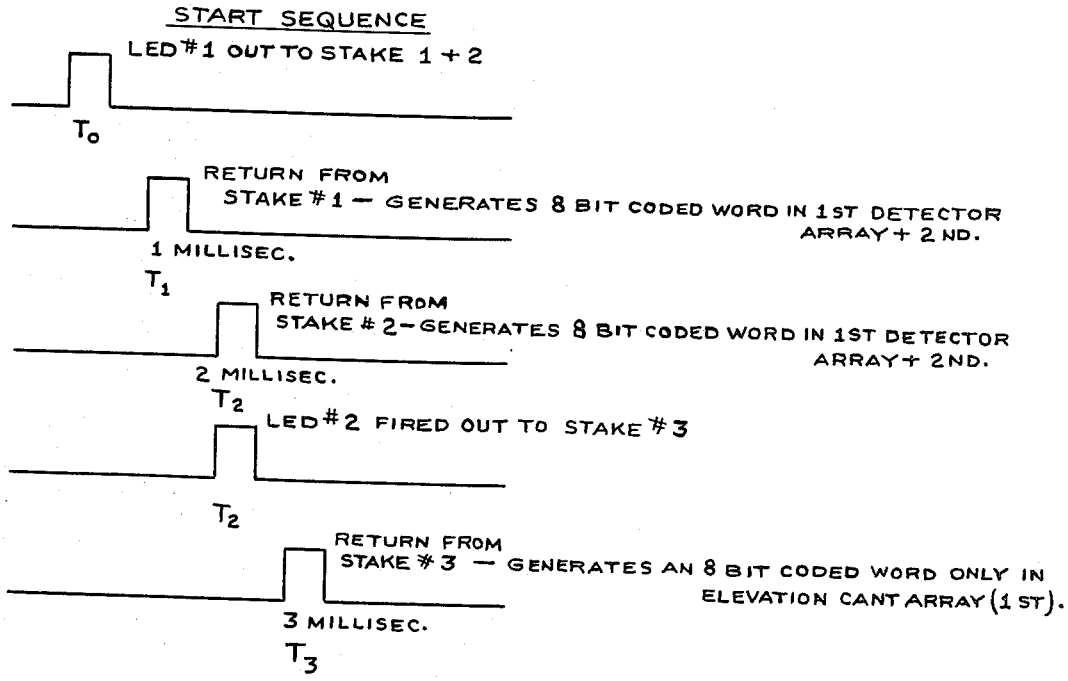
FIG. 13 is a time line graph showing the sequence of the occurrence of the various light pulses in the system of the invention.

FIG. 12 shows in schematic form an elevation/cant optical head 36 emitting an initial pulse from L.E.D. 46 at a certain predetermined time $T_0$, which time is also represented on the timing diagram FIG. 13. The initial light pulse from L.E.D. 46 is aimed towards aiming stakes 16 and 18 and is received by an optical transponder 122 mounted on the top of each aiming stake. The optical transponders 122 mounted on aiming stakes 16 and 18 may be identical to the optical transponder mounted on aiming stake 20 and will be described in more detail below with respect to FIGS. 16 and 17 below.

The initial light pulse from L.E.D. 46 received by the optical transponder 122 on aiming stake 16 is delayed 1 millisecond within the optical transponder so that at time $T_1$ the optical transponder 122 on stake 16 transmits a first light pulse from an L.E.D. (not shown) located on the transponder back to elevation/cant head 36 and azimuth head 34.

The initial light pulse emitted at $T_0$ from L.E.D. 46 is also received by the optical transponder 122 on aiming stake 18 and is there delayed 2 milliseconds so that at time $T_2$ it is retransmitted, as a second light pulse from an L.E.D. (not shown) located on the transponder on stake 18, back to elevation/cant head 36 and azimuth head 34. Also at time $T_2$, L.E.D. 50 is fired to produce a secondary light pulse aimed at the optical transponder 122 mounted on aiming stake 20 and is there delayed 1 millisecond and retransmitted as a third light pulse by an L.E.D. (not shown) on stake 20. Thus, at time $T_3$ the third light pulse is received by the cant portion 80 of elevation/cant head 36. Note that the third light pulse transmitted from aiming stake 20 is not received by azimuth head 34 because stake 20 is outside the field of view of head 34. Upon receipt of the first, second and third light pulses from the various optical transponders 122 mounted on aiming stakes 16, 18 and 20 there exists on the field masks of the detector arrays of elevation/-cant head 36 and azimuth head 34 a respective line image at each time $T_1$, $T_2$ and $T_3$. These line images existing at any one time $T_1$, $T_2$ or $T_3$ produce a signal the value of which is determined at $T_1$, $T_2$ and $T_3$ by which of detectors 111 to 119 is irradiated at the respective times. Time $T_1$ will be understood to be the time at which detector array associated with the elevation portion 82 and azimuth head 34 have a line image presented thereon which is representative of elevation and azimuth data concerning elevation and azimuth orientations of aiming stake 16 relative to optical head 14. Time $T_2$ will similarly be understood to define the time at which the detector arrays associated with elevation portion 82 and azimuth head 34 contain elevation and azimuth data of stake 18 relative to optical head 14. Time $T_3$ will be understood to define the time at which the detector array associated with cant portion 80 contains cant data of stake 20 relative to optical head 14.

The detector array utilized by elevation portion 82 is the same array utilized by cant portion 80; the difference being that use of the detector array is gated so that different information is obtained therefrom at different times.

Each detector 111 to 119 within each detector array, i.e. the azimuth detector array and the elevation/cant detector array, has associated therewith a preamplifier. For clarity, each elevation/cant detector preamplifier is designated 128, only one being shown, and each azimuth detector preamplifier is designated 130, only one being shown.

Similarly, each detector preamplifier 128 has associated therewith a threshold circuit 132, only one being shown, and each detector preamplifier 130 has associated therewith a threshold circuit 134, only one being shown.

The output of thresholds 132 and 134 is an eight bit gray-coded signal which is converted to binary form by gray to binary converters 136 and 138 in a manner well known to those skilled in the art.

Delay circuit 140 is utilized to sample thresholds 132 and 134 at times $T_1$, $T_2$ and $T_3$ in order to coincide with the delays generated by the optical transponders 122 mounted on aiming stakes 16, 18 and 20 respectively. Thus, the signal sampled in thresholds 132 and 134 is representative of the signal received in the azimuth and elevation/cant optical heads at $T_1$ and $T_2$ and received in the elevation/cant optical head at $T_3$.

Clocking input 141 is utilized to trigger delay circuit 140 simultaneously with (L.E.D. 46) driver 142 which causes L.E.D. 46 to emit the initial light pulse.

Prior to firing any rounds from the mortar, the mortar fire control system shown in FIG. 12 must be "initialized" with a certain set of azimuth, elevation and cant reference angles. This is generally accomplished by setting initial alignment switch 150 so as to enter data representative of the relative angular orientations of aiming stakes 16, 18 and 20 relative to optical head 14 in elevation reference holding registers 152 and 154, cant reference holding register 156, and azimuth reference holding registers 158 and 160. After the initialization procedure is completed, initial alignment switch 150 may be set so as to disconnect holding registers 152, 154, 156, 158 and 160 and so as to connect data from a gray-to-binary converter 136 to elevation holding registers 162 and 164, cant holding register 166, and so as to connect gray-to-binary converter 138 to azimuth holding registers 168 and 170.

Tracing the operation of the circuit shown in FIG. 12 at time $T_1$, it is noted that line 172 from delay circuit 140 will be activated at time $T_1$ so as to sample thresholds 132 and 134 and so as to gate holding register 152, 162, 158 and 168. If the initial alignment switch 150 is set so as to connect gray-to-binary converters 136 and 138 to gates 162 and 168 respectively, then the binary data from converters 136 and 138 will be gated into holding registers 162 and 168 by clocking means (not shown). Thus, after the first light pulse received by elevation/-cant head 36 and azimuth head 34 from aiming stake 16 is processed through gray-to-binary converters 136 and 138 the binary number corresponding to the relative angular data contained in that first light pulse will be stored in holding register 162 and 168. Holding register 162 will be representative of any elevation information (contained in the first light pulse) from aiming stake 16 in view of the fact that the source of information in that holding register 162 was ultimately from silicon detector array 124 which is part of elevation/cant head 36. Similarly, holding register 168 will contain any azimuth information (contained in the first light pulse) emanating from stake number 16 in view of the fact that the ultimate source of information for holding register 168 is the silicon detector array 126 which is part of azimuth head 34. Thus, the first light pulse generates two parameters of information by virtue of being received by two different silicon detector arrays 124 and 126 which are displaced 90° from each other.

In a similar manner, when line 174 from delay circuit 140 is activated (and line 172 is deactivated) then thresholds 132 and 134 will be sampled at $T_2$ and any gray-coded data existing at time $T_2$ will be gated into holding registers 154, 164, 160 and 170 after being converted to binary form. Simultaneously, (L.E.D. 50) driver 175 will be triggered in order to fire L.E.D. 50 towards aiming stake 20. Thus, in a manner similar to that described above, holding register 164 will contain elevation information received ultimately from aiming stake number 18 via the second light pulse (because of the 2 millisecond delay) and holding register 170 will contain azimuth information received from aiming stake number 18.

Similarly, line 176 is activated at time $T_3$ and holding register 166 will receive binary data representative of the gray-coded word existing on detector array 124 at time $T_3$. As may be seen from the timing diagram FIG. 13, the only light pulse relevant to system 10 at time $T_3$ is that which has been received by the cant portion 80 of elevation/cant head 36 from stake number 20 and, as described above, this third light pulse contains information existing at time $T_3$ representative of a cant deviation of mortar 12.

The information existing in binary form within each of the aforementioned holding registers is representative of angular data identified on FIG. 12 near the line emanating from the various holding registers in accordance with the following definition of the various angles (all relative to optical head 14):

$\theta_1$=initial azimuthal alignment of stake 16
$\theta_2$=initial azimuthal alignment of stake 18
$\Delta\theta$=lateral translation of stake 16
$\Delta a$=azimuthal shift of stakes of 16 and 18
$T_1$=initial elevation alignment of stake 16
$T_2$=initial elevation alignment of stake 18
$T_3$=initial elevation alignment of stake 20
$\Delta\phi$=vertical translation of stake 16
$\Delta e$=elevational shift of stake 16 and 18
$\Delta c$=cant shift of stake 20

Figure 14:
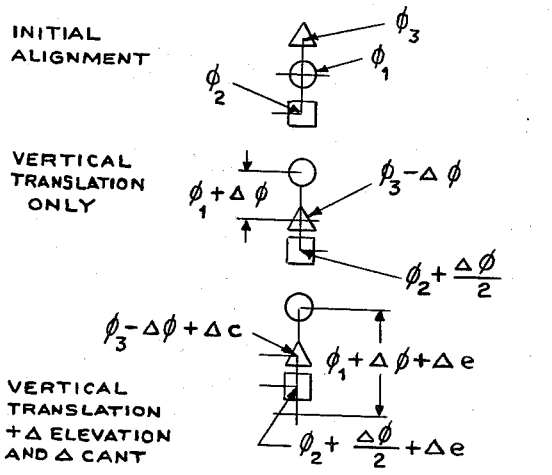
FIG. 14 is a schematic diagram of the elevation head focal plane display representative of the various angular orientations of the aiming stakes and the changes in these angular orientations after the occurrence of changes in vertical translation, elevation and cant.
Figure 15:
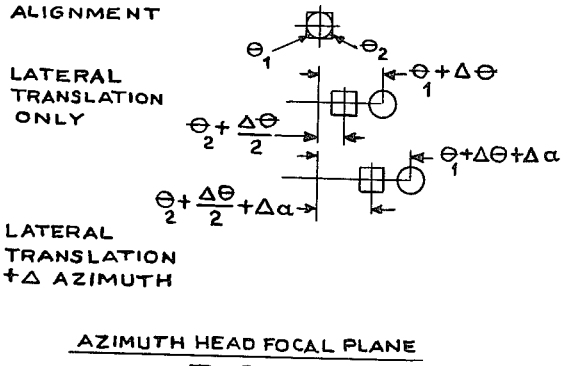
FIG. 15 is a schematic diagram of the azimuth head focal plane display representative of the various angular positions of the azimuth aiming stakes and the relative changes after the occurrence of lateral translation and azimuth changes.

By reference to FIG. 14 showing a diagrammatic presentation of the elevation head focal plane display and FIG. 15 showing a diagrammatic representation of the azimuth head focal plane display, those skilled in the art will understand that the azimuthal shift $\Delta a$, the elevational shift $\Delta e$ and the cant shift $\Delta c$ may be determined by various arithmetic manipulations of the terms shown in FIGS. 14 and 15.

These various arithmetic manipulations of the angular parameters shown in FIGS. 14 and 15 are accomplished by the circuitry disclosed in FIG. 12. The circuitry disclosed in FIG. 12 for the processing of the outputs of the various holding registers is intended to utilize the aforementioned angular parameters in order to determine, by various combinations of terms, the values of $\Delta e$, $\Delta c$ and $\Delta a$. These various values may ultimately be displayed by means well known to those skilled in the art on elevation display 180, cant display 181 and azimuth display 182.

Referring again to FIG. 12, the circuitry utilized for determining the value of $\Delta e$ and $\Delta c$ is shown schematically enclosed in box 200 labeled elevation and cant circuit, and the circuitry utilized for determining $\Delta a$ is shown as box 300 labeled azimuth circuit.

While the various arithmetic operations accomplished by elevation and cant circuit 200 and azimuth circuit 300 are well known to those skilled in the art, it may be instructive to trace the computational process. Accordingly, it will be recalled that holding register 152 contains in binary form the initial angular elevational position ($\phi_1$) of the optical transponder on aiming stake 16 relative to optical head 14. Similarly, holding register 154 contains the initial reference elevational angle of ($\phi_2$) representative of the relative elevational position of the transponder on stake 18 to the optical head 14. Similarly, holding register 156 contains the initial cant reference angle ($\phi_3$). Since the circuitry of the preferred embodiment performs binary subtraction by the "complement subtraction" method, the outputs of registers 152, 154 and 156 are converted to their respective negative values by "add 1" circuits 201, 202 and 203.

Considering further the output of holding register 162, it is noted that the data in register 162 is representative of elevational data obtained at time $T_1$ from the first light pulse (received from stake 16). This data in mathematical form may be represented, as shown in FIG. 14, by the expression $\phi_1+\Delta\phi+\Delta e$. It will be apparent to those skilled in the art that when the data is added to the output of "add 1" circuit 201 and adder circuit 204, the output will be $\Delta\phi+\Delta e$. Similarly, the output of adder 205 will be $\Delta\phi\div 2+\Delta e$, the output of adder 206 will be $-\Delta\phi+\Delta c$, the output of 202 will be $-\phi_3$. Those skilled in the art will further understand that the outputs of adders 204, 205 and 206 may be further manipulated by additional "add 1" circuits 207 and 208, multiplier circuit 209 and adder circuits 210, 211 and 212 to produce output representative of $\Delta e$ and $\Delta c$ in binary form. These outputs may then be utilized by, for example, being converted into visual displays.

The operation of azimuth circuit 300 is not discussed in detail herein since the performance of the various components disclosed in circuit 300 is similar to the components discussed above with respect to elevation and cant circuit 200. The output of Adder 301 will be $\Delta a$.

The outputs $\Delta e$, $\Delta c$ and $\Delta a$ are representative of the changes of optical head 14, and therefore mortar 12, from the initial reference elevation, cant and azimuth angular orientations relative to aiming stakes 16, 18 and 20. Since the threshold 132 and 134 may be sampled frequently the system produces output data which provides a relatively instantaneous means for determining whether the mortar has deviated from its initial aligned position and, therefore, the operator or gunner is immediately able to determine how much of a correction is desired in order to properly aim the mortar. Alternatively, the outputs $\Delta e$, $\Delta c$ and $\Delta a$ may be fed into a motorized system consisting of synchros and the like which would constitute a closed loop system to maintain the mortar relatively fixed to its initial alignment position.

Figure 16:
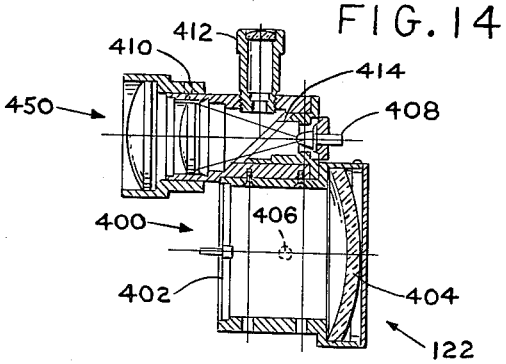
FIGS. 16 and 17 are side cross-sectional and front views respectively of an optical transponder mounted on each of the aiming stakes.
Figure 17:
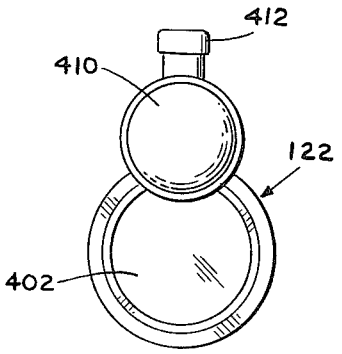

Referring briefly to FIGS. 16 and 17 showing side cross-sectional and front views respectively of an optical transponder 122, it is noted that transponder 122 consists of a receiving portion 400 and a transmitting portion 450. Receiving portion 400 consists of a telescope having a lens 402, a mirror 404 and a detector 406 at its focal point. Delaying circuitry (not shown) delays the signal received by detector 406 for 1 millisecond, in the preferred embodiment, after which time L.E.D. 408 is fired through lens system 410 back to optical head 14. Auxiliary sight 412 may be used with a lightly silvered mirror 414 to aim lens 410 at the optical head.

It will be understood by those skilled in the art that numerous other variations and modifications on the preferred embodiment of the invention disclosed herein may be made without departing from the scope thereof.

What is claimed is:

1. A mortar fire control system for indicating the angular orientation of a mortar barrel in any one predetermined plane of a three axis coordinate system, comprising:

means for determining a reference angular orientation of said barrel in said plane;

means for electrically storing said angular orientation of said reference;

means for electro-optically detecting a change of said barrel from said reference to a first angular orientation of said barrel in said plane;

means for determining said first angular orientation;

means for electrically storing said first angular orientation;

means for electrically determining by complement subtraction circuits a difference in said reference to said first angular orientation; and means for displaying said difference.

2. A mortar fire control system for indicating azimuth, elevation and cant angular orientations of a mortar barrel comprising:

means for determining a first azimuth angular orientation of said barrel relative to a predetermined absolute azimuth;

means for determining a first elevation angular orientation of said barrel relative to a horizontal reference;

means for determining a first cant angular orientation of said barrel relative to a vertical reference;

means for electrically storing each of said first azimuth angular orientation, first elevation angular orientation and first cant angular orientation;

means for detecting a change in azimuth orientation of said barrel from said first azimuth angular orientation to a second azimuth angular orientation;

means for electro-optically detecting a change in elevation orientation of said barrel from said first elevation angular orientation to a second elevation angular orientation;

means for electro-optically detecting a change in cant orientation of said barrel from said first cant angular orientation to a second cant angular orientation;

means for determining the magnitude of each of said second azimuth angular orientation, second elevation angular orientation and second cant angular orientation;

means for electrically storing each of said second azimuth angular orientation, second elevation angular orientation and second cant angular orientation;

means for electrically determining by complement subtraction circuits a difference in each of said first and second azimuth orientations, first and second elevation angular orientations and first and second elevation angular orientations and first and second cant angular orientations; and means for displaying each of said differences in azimuth, elevation and cant orientations.

3. A mortar fire control system for aiming a mortar barrel for repetitive firing along the same line, comprising:

a first aiming stake situated at a first predetermined azimuthal orientation from said mortar barrel and at a first predetermined distance therefrom;

a second aiming stake situated at said first predetermined azimuthal orientation from said mortar barrel and at a second predetermined distance therefrom, said second predetermined distance being greater than said first predetermined distance;

a third aiming stake situated at a second predetermined azimuthal orientation from said mortar barrel and at a third predetermined distance therefrom, said second predetermined azimuthal orientation being displaced 90° from said first predetermined azimuthal orientation and said third predetermined distance being substantially equal to said first predetermined distance;

first, second and third optical transponders and secured to each of said first, second and third aiming stakes respectively;

means associated with each of said optical transponders for emitting a light pulse signal in response to a light pulse received by said optical transponders;

an azimuth optical head and an elevation optical head each for being secured adjacent said mortar barrel and each for receiving said light signals emitted from said light emitting means associated with said first and second optical transponders;

a cant optical head secured adjacent said mortar barrel and for receiving said light signal emitted from said light emitting means associated with said third optical transponder;

means adjacent to said azimuth and elevation optical heads for emitting at least one initial first light pulse in said first predetermined azimuthal direction;

means adjacent to said cant optical head for emitting at least one initial second light pulse in said second predetermined azimuthal direction;

means associated with said azimuth optical head for detecting light signals received by said azimuth head;

means associated with said elevation and cant optical heads for detecting light signals received by said elevation or said cant head;

means for encoding said azimuth head detected light signals with data representative of the azimuthal orientation of said first and second optical transponders relative to said azimuth optical head;

means for encoding said elevation head detected light signals with data representative of the elevational orientation of said first and second optical transponders relative to said elevation optical head;

means for encoding said cant head detected light signals with data representative of the cant orientation of said third optical transponder relative to said cant optical head;

means for decoding each of said encoded azimuth, elevation and cant light signals, to determine the azimuthal, elevational and cant orientations of the respective optical transponders relative to the respective optical heads.

4. A mortar fire control system in accordance with claim 3 wherein said encoding means comprises:

a mask having a plurality of predetermined transparent areas thereon, said transparent area being transparent to the light frequency emitted from said light emitting means associated with said optical transponders; and a cylindrical mirror means for converting said light signals, emitted by said light emitting means associated with said optical transponders, to a line image for being superimposed on said mask.

5. A mortar fire control system in accordance with claim 4 wherein said decoding means comprises:

a plurality of detector means underlying said predetermined transparent areas for providing an electronic signal representative of said line image being superimposed on a predetermined combination of said predetermined transparent areas.

6. A mortar fire control system in accordance with claim 3 wherein the system further comprises:

means for determining the initial azimuth reference orientation of said first and second optical transponders relative to said azimuth optical head;

means for determining the initial elevation reference orientation of said first and second optical transponders relative to said elevation optical head;

means for determining the initial cant reference orientation of said third optical transponder relative to said cant optical head;

means for storing each of said reference orientations;

means for comparing said initial reference orientations to respective subsequently determined orientations to determine the difference therebetween;

means for displaying said determined difference in each of said azimuth, elevation and cant orientations.

7. A system in accordance with claim 3 wherein said elevation optical head and said cant optical head are combined in one unit and share means associated with said unit for encoding and detecting light signals received by either said elevation head or said cant head.

8. A system in accordance with claim 3 wherein said means for emitting, associated with each of said optical transponders, includes delay means for delaying the time between the receipt of a light pulse by said optical transponder and the transmission of a light pulse signal by said optical transponder.

9. A system in accordance with claim 3 further including means for displaying said determined azimuthal, elevational and cant orientations of the respective optical transponders relative to the respective optical heads.

10. A system in accordance with claim 6 or 9 which is further comprised of means associated with said system for determining whether said mortar has deviated from a predetermined initial alignment position.

11. A system in accordance with claim 3 wherein said second predetermined distance is approximately twice said first predetermined distance.

* * * * *